US005320262A

United States Patent [19]

Levis

[11] Patent Number: 5,320,262

[45] Date of Patent: Jun. 14, 1994

[54] INTERNAL FRAME PACK AND SUPPORT DEVICE THEREFOR

[75] Inventor: Jeffrey D. Levis, Fresno, Calif.

[73] Assignee: Mountain Equipment, Inc., Fresno, Calif.

[21] Appl. No.: 970,799

[22] Filed: Nov. 3, 1992

[51] Int. Cl.[5] ..... A45F 3/08

[52] U.S. Cl. ..... 224/210; 224/212; 224/261

[58] Field of Search ..... 224/210, 212, 213, 211, 224/209, 261, 263, 907

[56] References Cited

U.S. PATENT DOCUMENTS

| | | | |
|---|---|---|---|
| 797,667 | 5/1905 | Davis . | |
| 2,421,244 | 5/1947 | Daiber . | |
| 2,611,519 | 9/1952 | Utterstrom . | |
| 3,033,431 | 5/1962 | Henderson et al. . | |
| 3,114,486 | 12/1963 | Flexman . | |
| 3,191,828 | 6/1965 | Senne . | |
| 3,233,803 | 2/1966 | Gray . | |
| 3,733,017 | 5/1973 | Pletz . | |
| 3,774,825 | 11/1973 | Schone et al. . | |
| 3,938,718 | 2/1976 | Madison . | |
| 4,088,252 | 5/1978 | Grunberger . | |
| 4,135,654 | 1/1979 | Chu . | |
| 4,303,186 | 12/1981 | Ollinger . | |
| 4,420,103 | 12/1983 | Douglass | 224/210 |
| 4,572,414 | 2/1986 | Blatt . | |
| 4,750,654 | 6/1988 | Menetrier | 224/211 |
| 4,842,173 | 6/1989 | Scherer . | |
| 4,892,240 | 1/1990 | Bell . | |
| 4,911,346 | 3/1990 | Shallmann . | |
| 4,934,573 | 6/1990 | Jaeger | 224/210 |
| 5,131,576 | 7/1992 | Turnipseed . | |

FOREIGN PATENT DOCUMENTS

| | | | |
|---|---|---|---|
| 2278290 | 3/1976 | France | 224/209 |
| 2371164 | 7/1978 | France | 224/211 |
| 2454285 | 12/1980 | France | 224/210 |
| 2646998 | 11/1990 | France | 224/209 |

*Primary Examiner*—Renee S. Luebke
*Attorney, Agent, or Firm*—Mark D. Miller

[57] ABSTRACT

An internal frame backpack having a large flat closable pocket along one entire side which pocket is adapted to receive a rigid contoured rectangular piece in order to provide support for said pack. The piece may be corrugated for additional strength, and is specially molded to conform to the lumbar region, shoulders, back and head of a human wearer so as to minimize interference with the free movement of the wearer's back, shoulders and head. An alternative embodiment provides contours adapted to receive the shoulder straps of the backpack to avoid their rubbing against the back of the user.

9 Claims, 3 Drawing Sheets

INTERNAL FRAME PACK AND SUPPORT DEVICE THEREFOR

BACKGROUND OF THE INVENTION

The present invention relates to packs used in outdoor backpacking, and more particularly to a new and improved support device for an internal frame backpack.

In the field of outdoor sport backpacking, there are several distinct styles of packs. Common day packs are used by students to carry books, or by hikers to carry provisions for a very short trips (picnics or hikes) lasting usually less than a full day. Such day packs usually include two zipper-closed compartments (a large one and a pocket-sized one), and a pair of adjustable shoulder straps. Larger frameless overnight packs are available to provide more space for supplies for a single night outdoors. Finally, extended trip frame packs are available for trips lasting several days or weeks.

For extended trip backpacking enthusiasts, there are at least two distinct styles of packs that are widely used: external frame packs and internal frame packs. External frame packs are generally characterized by one or more large compartments (the pack) having several various sized pocket compartments sewn thereto all of which is attached to a metal frame. The frame is outside of and external to the compartments of the pack, and is attached to the pack by stitches, bolts or other similar means. Two shoulder straps and a waist belt are typically attached to the frame, and not to the pack itself, so that the frame acts as the support for the pack. In use, parts of the metal frame are visibly apparent between the wearer and the pack.

Internal frame packs are generally characterized by one or more large compartments (the pack) having several various sized pocket compartments sewn thereto, on the inside of which a metal support frame (usually in the form of two metal strips or stays mounted in a parallel pattern) is placed. Typically, one or more tubular sleeves are sewn onto the inside of the largest, lower compartment of the pack (in a parallel pattern) into which the metal strips are slidably placed. In place, these strips define a rigid surface on the otherwise flimsy pack. On the outside of this rigid surface the shoulder straps and waist belt are attached, so that the weight of the load in the pack is transferred to the waist belt of the user, and not the shoulders.

Internal frame packs are typically used in winter camping where the user is on skis and requires a low center of gravity. Other uses for internal frame packs are for rock climbing or other technical camping where the bulk of an external frame might inhibit or endanger the wearer. The most important benefit of an internal frame pack is that it fits closely to the body of the user. This close fit provides warmth as well as a low center of gravity, and the separate strips of the internal frame allow the pack to move with the user (torsional flex) during skiing or technical climbing.

External frame packs are generally used in non-technical summer backpacking and hiking. The rigidity of the external frame provides a much more efficient transfer of the load in the pack to the waist belt of the user than an internal pack. However, the same rigidity of the external frame prohibits such a pack from moving or bending with the user during climbing, etc.

One of the most common problems presented by internal frame packs is a lack of good support by the internal frame itself. A very full pack will protrude slightly below and significantly above the frame itself, often to the point where the frame provides little more than a location at which the user wears the pack. Weight shifting above the frame tends to put the whole pack off balance, and the frame does little by way of compensating for it. The greater the load, the more deformed the support strips become. Thus, with larger loads, weight transfer to the waist belt is often very inefficient.

Other related problems with internal frame packs are the discomfort and fatigue suffered by the wearer because the frame is, by definition, flimsy and insubstantial. As more is loaded into the pack, it bows away from the user's back (in a barrel shape) failing to transfer the load to the waist, and instead putting more of the load on the user's shoulders.

SUMMARY OF THE INVENTION

The present invention solves many of the support and fatigue problems presented by internal frame packs by providing an integral frame pack having a large, thin closable pocket along one entire side into which a single molded, contoured piece of rigid material is slidable placed. In an alternative embodiment, the pocket is eliminated so that the molded, contoured piece becomes the back of the pack itself. The contoured piece is shaped to conform to the back of a human, including a curve in the region of the lumbar vertebrae, recesses for the shoulders on each side, and a recess at the top for the neck and head. The molded piece is longitudinally corrugated in order to add strength. The molded piece is either attached directly to the fabric of the pack itself, or it is slid into the pocket and is zipped, snapped or otherwise fastened into place to form a rigid backing for the pack It is therefore a primary object of the present invention to provide a simple support piece for an internal frame pack that provides the superior support associated with external frame packs while still providing the low center of gravity and torsional flex associated with internal frame packs.

It is a further important object of the present invention to provide a support piece for an internal frame pack that conforms to the contours of the human back, shoulders and head so as to minimize fatigue and allow for a broad range of movement to the wearer.

It is a further object of the present invention to provide a support piece for an internal frame pack that allows full support along an entire side of the pack.

It is a further object of the present invention to provide a support piece for an internal frame pack that provides a substantial base for support and transfer of load to the waist of the pack when the pack is filled to capacity.

It is a further object of the present invention to provide an embodiment of an internal frame pack having a closable pocket along one entire side into which a contoured, molded support piece may be slidably placed.

It is a further object of the present invention to provide an embodiment of an internal frame pack having a contoured, molded support piece along one entire side attached to and making up a part of the pack itself.

It is a further object of the present invention to provide a support piece for an internal frame pack that is longitudinally (vertically) corrugated for added strength and support to transfer the load to the waist of the pack, while still allowing a significant degree of lateral (twisting) movement by the wearer.

It is a further object of the present invention to provide a support piece for an internal frame pack that is specially contoured so that the outside shoulder straps of the pack may fit so as to maintain a consistent contour with the human back.

It is a further object of the present invention to provide a support piece for an internal frame pack having variable sizes and contours for men, women and children.

BRIEF DESCRIPTION OF THE CONTENTS

DETAILED DESCRIPTION OF THE DRAWINGS

Figure 1:
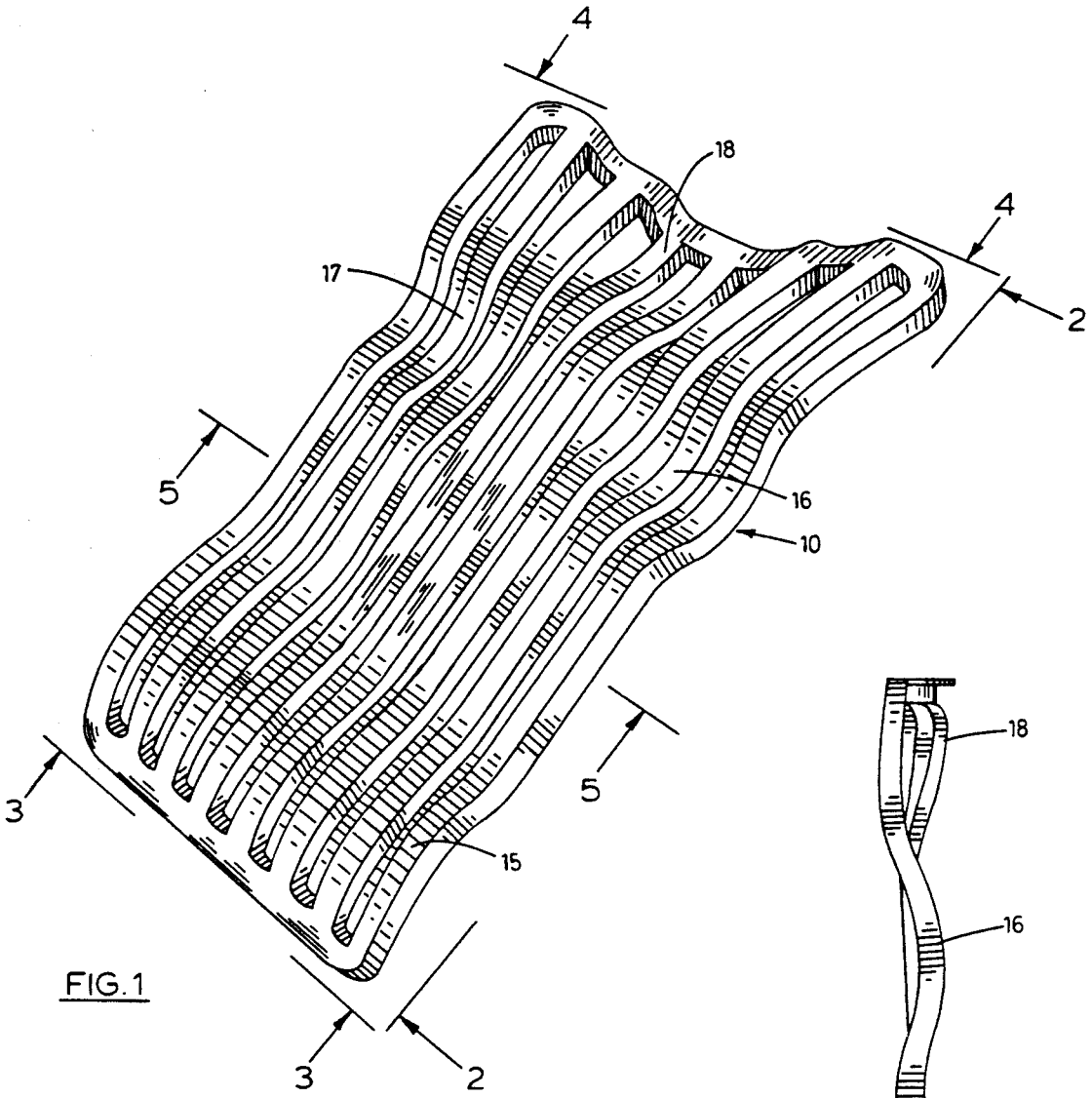
FIG. 1 is a perspective view of the support piece of the present invention.
Figure 3:
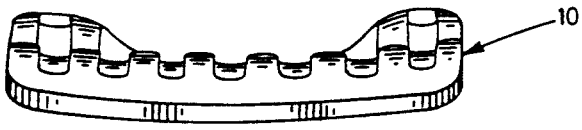
FIG. 3 is a bottom view of the support piece of the present invention along line 3—3 of FIG. 1.
Figure 4:
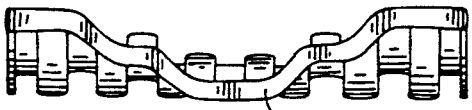
FIG. 4 is a top view of the support piece of the present invention along line 4—4 of FIG. 1.
Figure 5:
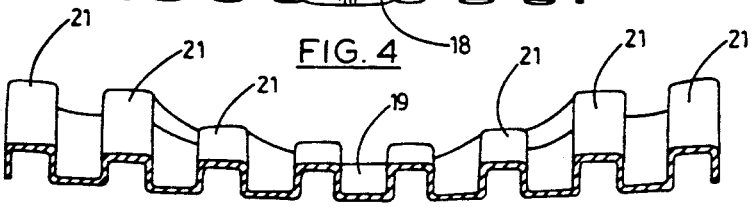
FIG. 5 is an end cutaway view of the support piece of the present invention along line 5—5 of FIG. 1.
Figure 2:
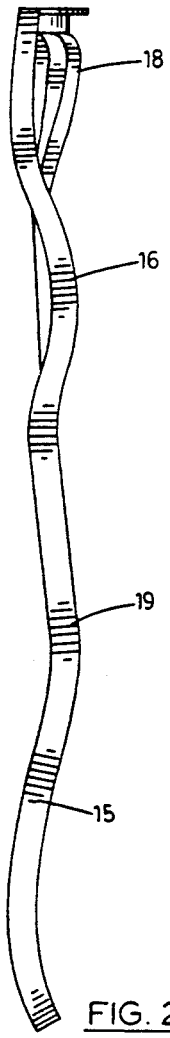
FIG. 2 is a side view of the support piece of the present invention along line 2—2 of FIG. 1.
Figure 6:
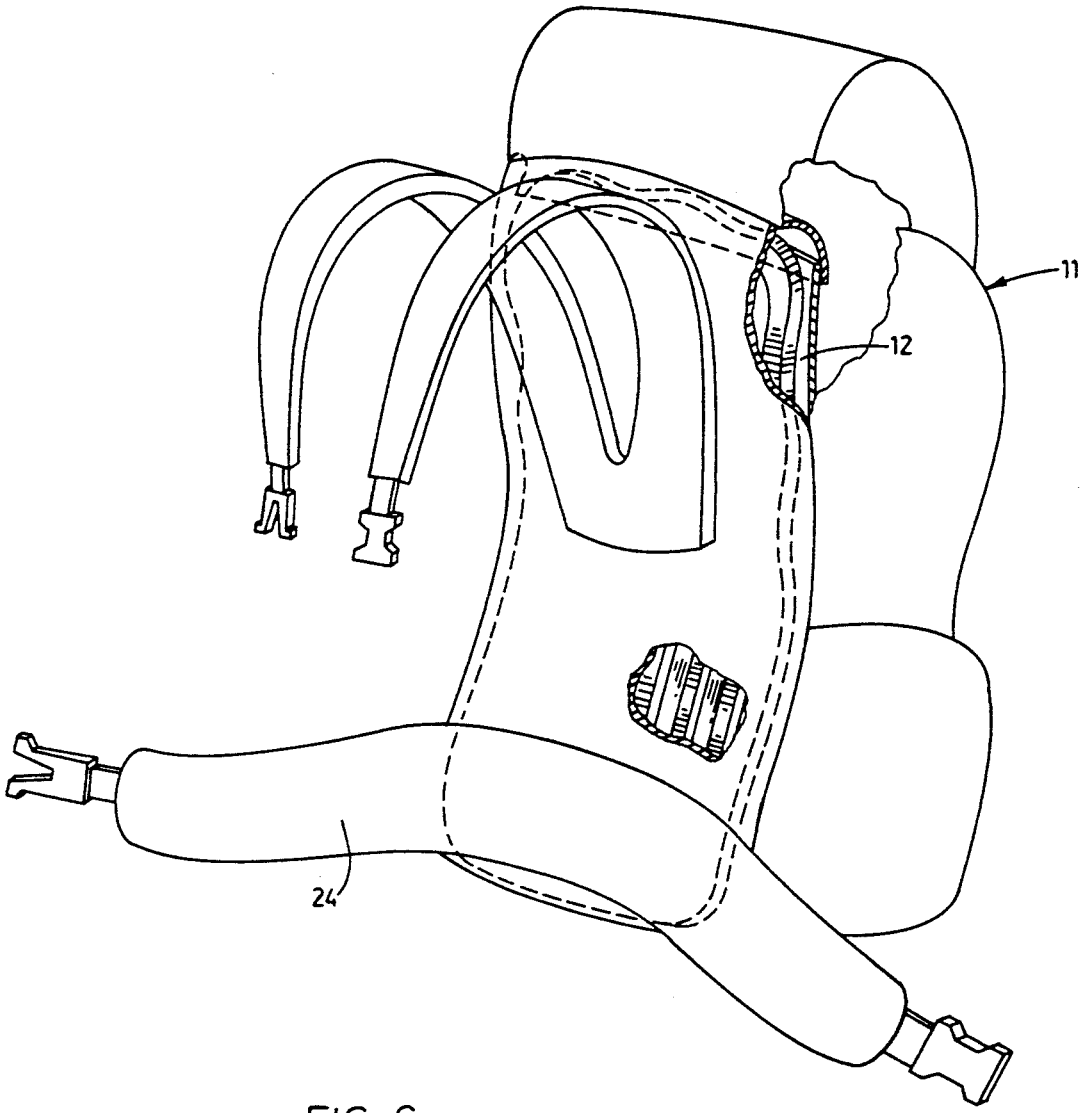
FIG. 6 is a partially cut away perspective view of the support piece of the present invention in place in a typical pack.
Figure 7:
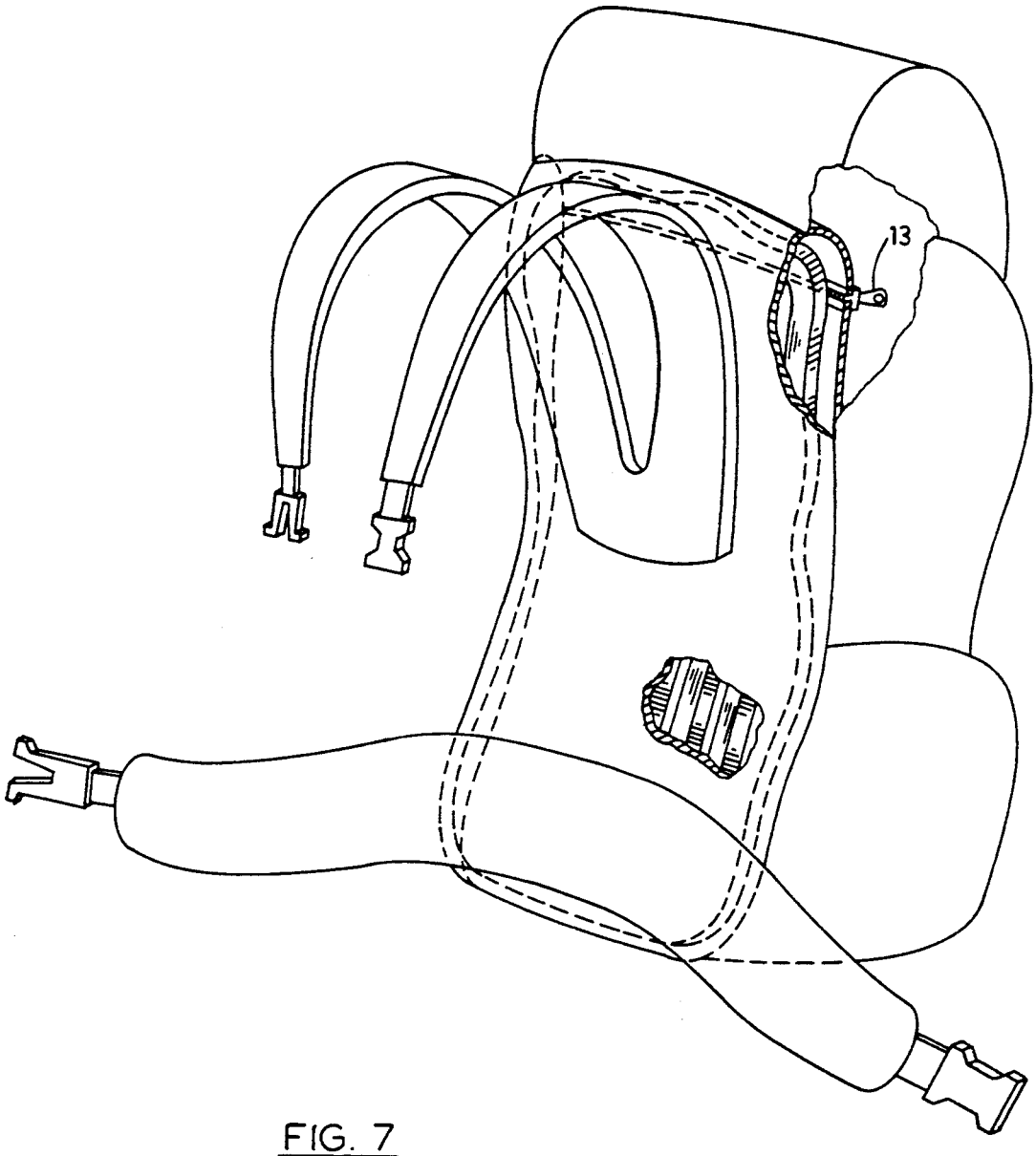
FIG. 7 is a partially cutaway perspective view of the support piece of the present invention in place in an alternative version of the pack.

Referring to the drawings wherein like reference characters designate like or corresponding parts throughout the several views, and referring particularly to FIGS. 1, 2 and 3, it is seen that the invention includes a corrugated rectangular piece, generally 10, and a pack, generally 11. A special pocket 12 which extends along the entire back side of the pack is provided with a zipper 13 (see FIG. 7) or other closing means (see FIG. 6) at the top of the pack.

The corrugated piece 10 includes numerous contours and recesses. A concavedly bowed area 15 is transversely provided near the bottom of the piece 10 to correspond with the location of the lower lumbar portion of the human back (see FIG. 2). This bowed area 15 helps transfer the weight of the pack 11 borne by the piece 10 directly to the waist belt 24 of the pack.

A pair of recesses 16 and 17 may be provided at the edges of the longitudinal sides of piece 10 at outside locations just above the middle of piece 10. These recesses 16 and 17 are designed to correspond to the locations of the two shoulder areas of a human back. Another recess 18 is provided at the middle of the top edge of the piece 10 to correspond to the location of the back of a human head. Each of said recesses 16, 17, and 18 provides space for freedom of movement of the corresponding human body part (shoulders and head).

The entire central region 19 of piece 10 is slightly recessed in order to comfortably accommodate the human back. A series of corrugated ribs 21 are provided along the longitudinal length of the piece 10 to provide additional strength.

In an alternative embodiment (not shown), the pocket 12 of the pack is eliminated, and the support piece 10 is sewn, glued or otherwise attached directly to the fabric of the pack and becomes an irremovable part thereof.

DESCRIPTION OF THE PREFERRED EMBODIMENTS

In the preferred embodiment, the piece 10 of the present invention is made of rigid lightweight plastic or metal, although wood or other material may also be used. It is designed to be cast from a mold, and can be made in different sizes for men, women and children. The corresponding pack 11 may be made of nylon, canvas or other suitable material, and is provided with a large pocket along one entire side. The pocket has a closing means 13 at the top such as a zipper, VELCRO, snaps, or the like. The piece 10 is slid into pocket 12 and held in place by the closing means 13.

The invention is designed so as to minimize any interference with the user's ability to move his/her head or shoulders, while at the same time providing significantly improved support to the internal frame pack. The size and location of the plate within the pack also serves to transfer most of the weight borne by the pack to the lower lumbar area where it is transferred, in turn, to the waist belt 24 of the pack.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. In combination, an internal frame backpack having a large flat pocket along one side adapted to receive a stiffened rectangular piece in order to provide support for said pack, said pocket having a closing means for holding said piece therein wherein said rectangular piece has a top edge, a bottom edge opposite said top edge, and two intermediate longitudinal side edges and is longitudinally corrugated for strength, and wherein said piece is molded to conform to the features of a human back, and wherein said piece is provided with an inwardly bowed area near the bottom edge of said piece which corresponds to the lumbar region of a human back, and said piece is provided with a pair of recessed areas along the longitudinal edges of said piece, which recesses correspond to the location of the shoulders of a human back.

2. The backpack described in claim 1 wherein said piece is provided with a recess in the top edge of said piece which corresponds to the location of the back of a human neck.

3. The backpack described in claim 2 wherein said piece is provided with a bowed recessed area which corresponds to the location of the middle of the human back.

4. A single stiffened corrugated rectangular Plastic piece for use in an internal frame backpack having a top edge, a bottom edge opposite said top edge, and two intermediate longitudinal side edges that is molded to generally conform to the contours of a human back, wherein said piece is bowed in an outward direction at the bottom edge, and wherein said piece is provided with a concave bow intermediate the side edges in the middle thereof.

5. The piece described in claim 4 wherein a recessed area is provided at the top edge of said piece.

6. The piece described in claim 5 wherein a pair of recesses are provided on each side of said piece above said concave bow and below said recessed area.

7. In combination an internal frame pack wherein a single large stiffened rectangular plastic piece forms one side thereof in order to provide support for said pack wherein said piece has a top edge, a bottom edge opposite said top edge, and two intermediate longitudinal side edges, is longitudinally corrugated, and is molded to generally conform to the contours of a human back, wherein said piece is bowed in an outward direction at the bottom edge, and wherein said piece is provided with a concave bow intermediate said side edges.

8. The pack described in claim 7 wherein a recessed area is provided along the top edge of said piece.

9. The pack described in claim 8 wherein a pair of recesses are provided along each side of said piece above said concave bow and below said recessed area.

* * * * *